US005405109A

United States Patent [19]

Nordnes

[11] Patent Number: 5,405,109

[45] Date of Patent: Apr. 11, 1995

[54] SUPPORT FOR A FOREARM

[76] Inventor: Mathis Nordnes, Hellaveien 39, N-2013 Skjetten, Norway

[21] Appl. No.: 155,088

[22] Filed: Nov. 18, 1993

Related U.S. Application Data

[63] Continuation of Ser. No. 855,700, May 4, 1992, abandoned.

[30] Foreign Application Priority Data

Nov. 3, 1989 [NO] Norway ..... 894388

[51] Int. Cl.[6] ..... B43L 15/00

[52] U.S. Cl. ..... 248/118.3; 248/918; 248/279

[58] Field of Search ..... 248/118.1, 118.3, 118.5, 248/118, 918, 231.7, 287, 279; 132/73; 400/715, 717, 718; 273/148 B; 297/411.35, 411.31

[56] References Cited

U.S. PATENT DOCUMENTS

| | | | |
|---|---|---|---|
| 607,675 | 7/1898 | Barr | 248/118.1 |
| 1,096,327 | 5/1914 | Thorniley | 248/279 X |
| 1,277,169 | 8/1918 | Anderson | 248/118.3 |
| 1,386,151 | 8/1921 | Brewer | 248/279 X |
| 3,124,328 | 3/1964 | Kortsch | 248/118 |
| 3,929,309 | 12/1975 | DeVore | 248/279 X |
| 4,996,977 | 3/1991 | Tiedeken | 248/118 X |
| 5,201,485 | 4/1993 | Moss et al. | 248/118 |
| 5,281,001 | 1/1994 | Bergsten et al. | 248/118 X |

FOREIGN PATENT DOCUMENTS

| | | | |
|---|---|---|---|
| 63158 | 1/1945 | Denmark | 400/715 |
| 154714 | 1/1986 | Norway . | |
| 459313 | 12/1985 | Sweden . | |
| WO89/00111 | 1/1989 | WIPO | 248/118 |
| WO89/04623 | 6/1989 | WIPO . | |

*Primary Examiner*—Karen J. Chotkowski
*Attorney, Agent, or Firm*—Kane Dalsimer Sullivan Kurucz Levy Eisele and Richard

[57] ABSTRACT

Support for a person's forearm, adapted for use when working in a seated position, especially at a table, the underside of a longitudinal support cushion (8) being adapted for use as a seat for the user's forearm, the support cushion being secured to one part of a bearing, the support cushion being displaceable in the longitudinal direction of the cushion in relation to a second part of the bearing, which is adjustable in the height from and being connected to a socket arm (3), the support cushion furthermore being rotatable about a first substantially vertical axis (11), the socket arm being journalled to a clamp (9) for securement of the support to a working table, the socket arm being rotatable about a second substantially vertical axis (12) at a distance from the first axis (11), the clamp thereby being adapted for securement to the working place, such as the edge of a table, the longitudinal displacement allowing for movement of the user's hand from and towards the edge of the table, the distance between the two axes allowing for transversal displacement of the arm and the rotation of the cushion about the first axis allowing for the arm to be turned angularly about the first axis.

5 Claims, 1 Drawing Sheet

SUPPORT FOR A FOREARM

This application is a continuation of application Ser. No. 07/855,700, filed May 4, 1992, now abandoned.

BACKGROUND OF THE INVENTION

The present invention is related to a support for a person's forearm according to the preamble of the claims.

Increasingly occupational deceases are found in connection with persons performing their daily work in a seated position thereby maintaining arms and hands at a level above the work to be performed. This in fact means static or almost static work in a considerable period of time of a working day. The work to be performed is limited to a relatively small working area, such as a typewriter, calculator or computer keyboard or assembly works of diferent kinds, such as in a production line, drawing works etc.

Even when moving the hands within a limited area, the forces necessary for holding the hands and the forearms in a position above the working place, is so large that substantial counter forces have to be excited in the shoulders, the back, the back of the neck, the upper arm as well as the forearm and the wrists. This will be the case even when using a chair adequately adjusted to the person involved and the working place. The muscles of the body counteract naturally to the muscles supporting the weight of the hands and arms. As well known such counteracting give a number of problems to the body.

Periods with pain in shoulders, back and back of the neck especially as well as in the elbow points frequently occurs in the above mentioned categories of work as well as others. The days of absence from work due to such problems is enormous and partly undiscovered.

Several attempts have been made to solve these problems or decrease the pain and absence. Known is for example a support for the forearm which to a certain degree decreases the load as part of the forearm weight may be taken up by the device. A limitation, however, has been found in the use of such a support as the movement of the hand is limited and not given sufficient freedom within the necessary area. This solution therefore has not brought forward the final solution to these problems.

In most cases as mentioned above, it is necessary for the hands to be moved freely, independently of each other within a limited area, however, substantially in the same horizontal or possibly inclined plane. With known solutions the arm must be lifted from the support if the fingers should cover the entire working area as mentioned above. This limitation substantially limits the use of the support and above all limits the contribution of the support to a relaxed working position for the entire body.

SUMMARY OF THE INVENTION

With the support for the forearm according to the present invention, a support is provided for an arm, or when using two distanced supports, even for both arms, thereby allowing movements of the hand within a desired, relatively large area which substantially correspond with the working area for a normal working place in a seated position. It is of substantial importance that the hand or hands everywhere within this area may rest with the entire weight of the forearm and hand on the support.

Furthermore the support also may completely take over the load in case the user should lean forwards, stretch the body etc. thereby transmitting a substantial portion of the weight of the upper part of the body to the support. Corresponding prior art supports do not exist, whether on the market nor in the literature.

The above mentioned advantages are achieved with the support for the forearm according to the present invention as defined by the features stated in the claims.

The support for the forearm according to the present invention can be adjusted in the height for optimal adaptation to the user in question, allowing turning of the forearm in a plane parallel to the table on which the work is performed and to which the support is fixed. A transversal movement parallel to the edge of the table and a displacement out from and towards the body, as well as combinations of such movements are enabled with the inventive support.

The support for the forearm may be used for one arm alone, such as in connection with assembly work, use of a calculator etc., or with one support according to the present invention for each arm, whereby the distance between the users two arms easily can be adjusted by the user when clamping the support correspondingly to the working table.

BRIEF DESCRIPTION OF THE INVENTION

The drawing discloses in

FIG. 1 shematically a side-view of a support for the forearm according to the present invention, FIG. 2 discloses the support in a front-view and FIG. 3 discloses schematically in a plan view, the freedom of arm movement with the support.

DETAILED DESCRIPTION OF THE INVENTION

Figure 2:
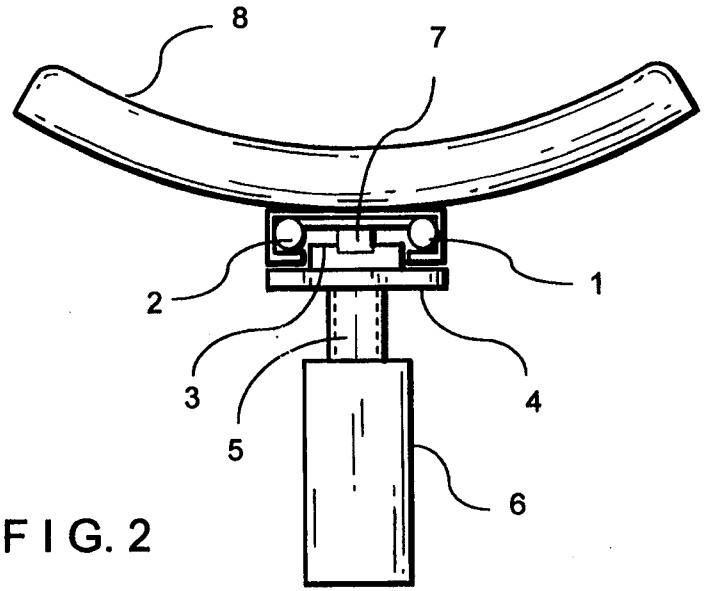

The support for the forearm according to the present invention comprises a resting cushion 8 having a length suitably corresponding to half of the length of users forearm and preferably being equipped with an upholstery, most suitably covered with leather, in such a way that the forearm comfortably rests on the cushion. Suitably the cushion 8 has a bawl shaped transversal section as disclosed in FIG. 2.

The underside of the cushion 8 is secured to a rail well known in the art, such as according to the roll on system. Balls 2 are captured in a retainer 3 in the entire length of the rail 1 whereby a plate 4 extends along the edges outside the rail 1 and being connected with the retainer 3. The rail 1 extends along substantially the entire underside of the cushion 8. Having the fixed plate 4 anchored, the cushion may be displaced a length corresponding to the length of the rail 1 and the retainer 3, e.g. the length of the cushion, corresponding to distance necessary for stretching the arm in the different cases.

The support of the cushion 8 to the plate 4 is made such that large forces and movements may be transferred from the user against the cushion 8 to the plate 4, also with the cushion in its end positions. The forces are transferred suitably to the underlaying table etc. Suitably a stop 7 is provided on the retainer 3 at both ends of the rail.

A bolt 5 is secured to the plate 4 and vertically threaded into a socket arm 6. The plate 4 and thereby also the cushion 8 in this manner may be adjusted in the height by turning the bolt 5 in or out of the socket arm 6. This embodiment additionally provides the user with the possibilities in a very simple and secure way to turn the cushion 8 horizontally around the bolt, thereby covering a working area corresponding to a circle segment which can be moved from a position on the table where the cushion is arranged away from the user and to a position where the cushion is turned back against the user.

The end of the socket arm 6 opposite the bolt 5 comprises an upper and a lower, horizontal flange between which is mounted an easily rotatably clamp 9, preferably with upper and lower ball bearings. The clamp 8 comprises an upper flange adapted for arrangement on the upper surface of a table 14, and a lower flange having a securing bolt 15 for securing the clamp 9 to the table. The clamp 9 thereby easily can be secured to the edge of a table 14 as disclosed in FIG. 3.

Figure 3:
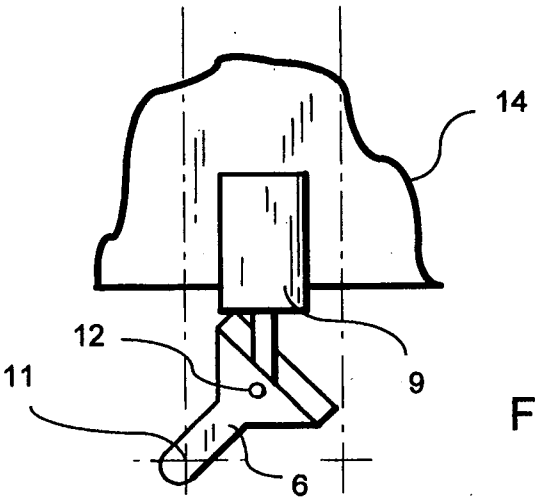

As also disclosed in FIG. 3 the working area is substantially increased when making the socket arm 6 rotatable, in addition to the possible rotation of the cushion 8. The cushion 8 may be turned around the axis 11 of the bolt 5 in the socket arm 6. Furthermore the socket arm 6 itself may be turned around the axis 12 at the connection between the clamp 9 and the socket arm 6. Suitably the lower flange 13 of the socket arm is extended in such a way that its front edge provided an abutment and a stop against the clamp 9, thereby limiting the possible rotation angle of the socket arm 6, as can be seen from FIG. 3.

Furthermore the bearing of the socket arm 6 in the clamp 9 may be provided with a certain friction to movement to achieve a certain dampening of the transversal movement.

Figure 1:
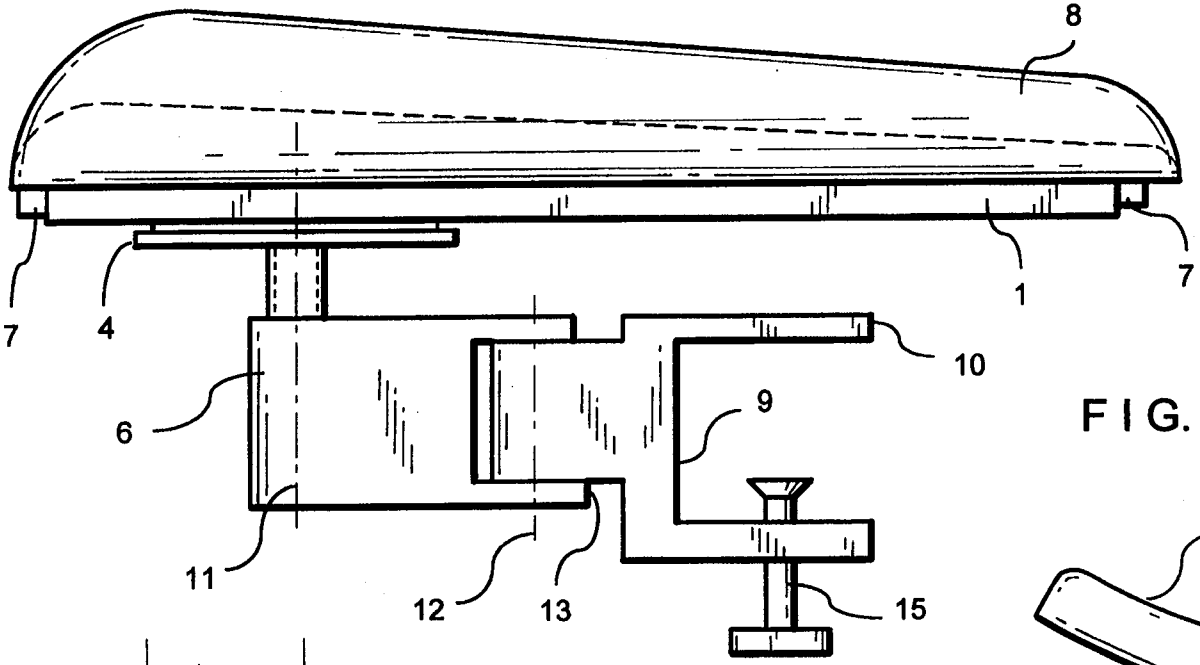

The cushion 8 suitably is concave to provide a comfortable and steady rest for the forearm. As disclosed in FIG. 1 the cushion 8 furthermore is inclined downwards towards the rail, such as downwards from the user to conform with the shape of the forearm, or when turning the cushion 8 to conform with special wishes from the user in connection with the work to be performed.

The axis 12 on FIG. 3 is disclosed at a distance outside the abutment of the clamp 9 on the table 14. By suitable choice this distance may be changed in such a way that the rotation radius of the socket arm may be increased or decreased by arranging the axis 12 closer to or further away from the table, or even, by a special embodiment, arranging the axis 12 through the flanges of the clamp 9 and the table as well.

For suitable arrangement of a working place for a keyboard connected to a computer or a type writer, two supports according to the present invention are clamped to a table at a distance from each other suitable for the user. The length of the upper flange of the clamp 9 suitably has such a dimension that the edge of the keyboard may abut against this edge 10. The possible movements provided by the support give full availability to all the different parts of the keyboard, maintaining full support in the entire area.

Corresponding arrangement of two supports furthermore may be suitable for other types of works, such as production works for assembly, soldering etc.

By the use of only one support for the forearm according to the present invention a secure support is provided for working places where one hand apparatus such as calculators are used during a long period of a working day.

I claim:

1. A support for a person's forearm for use when working in a seated position, for example at a table, said support comprising:

a first longitudinal support cushion constructed and arranged to form a seat for a forearm, having an underside and a length equal to half the length of the forearm;

a socket arm having a first and second end;

bearing means being adjustable in height and having a first part attached to said cushion and a second part secured to said first end, said bearing means being constructed and arranged to permit said cushion to move in a longitudinal direction with respect to said bearing means, and to pivot about a first substantially vertical axis and including a plate slidably mounted on said cushion and a bolt secured to said plate and threadedly engaging said socket arm; and a first clamp for mounting said support on a work surface, said second end being journaled to said clamp and being rotatable about a second substantially vertical axis passing through said clamp and spaced at a distance from said first axis, whereby said cushion is held substantially horizontal with respect to said clamp and said work surface, and is free of horizontal rotation with respect thereto, said cushion further being held directly above the work surface as engaged by said clamp with a vertical space between said work surface and said cushion;

said distance being selected to allow transverse movement of said forearm by the rotation of said first cushion and said socket arm about said axes.

2. The support of claim 1 wherein said bearing means includes a linear bearing having ball bearings, and a retainer; said plate being connected to said socket arm and rigidly mounted on said retainer and said bearing means further including a rail mounted on said underside and capturing said ball bearings.

3. The support of claim 2 wherein said bearing means further comprises a bolt connected to said retainer and threaded into said socket arm to make said cushion height adjustable and pivotable about a bolt axis.

4. The support of claim 1 wherein said work surface includes a keyboard, and said clamp abuts against said keyboard.

5. The support of claim 1 wherein relative rotation of said clamp and said second end about said second substantially vertical axis is limited to a range of substantially 90°.

* * * * *